United States Patent [19]

White

[11] Patent Number: 4,829,973

[45] Date of Patent: May 16, 1989

[54] CONSTANT SPARK ENERGY, INDUCTIVE DISCHARGE IGNITION SYSTEM

[75] Inventor: Robert C. White, La Mesa, Calif.

[73] Assignee: Sundstrand Corp., Rockford, Ill.

[21] Appl. No.: 133,390

[22] Filed: Dec. 15, 1987

[51] Int. Cl.[4] ..... F02P 1/00

[52] U.S. Cl. ..... 123/609; 123/610; 123/611

[58] Field of Search ..... 123/609, 610, 611, 418; 315/209 T

[56] References Cited

U.S. PATENT DOCUMENTS

| | | | |
|---|---|---|---|
| 3,831,571 | 8/1974 | Weber | 123/148 E |
| 3,874,351 | 4/1975 | Asler et al. | 123/117 R |
| 3,937,193 | 2/1976 | Kim | 123/117 R |
| 3,943,896 | 3/1976 | Greene et al. | 123/117 R |
| 4,008,698 | 2/1977 | Gartner | 123/117 R |
| 4,018,202 | 4/1977 | Gartner | 123/148 E |
| 4,019,484 | 4/1977 | Mori | 123/148 E |
| 4,121,556 | 10/1978 | Bigliani et al. | 123/148 E |
| 4,212,280 | 7/1980 | Fresow et al. | 123/611 |
| 4,237,835 | 12/1980 | Rabus et al. | 123/418 |
| 4,309,973 | 1/1982 | Tamura | 123/611 |
| 4,625,704 | 12/1986 | Wheelock | 123/611 |
| 4,739,743 | 4/1988 | Iwata | 123/610 |

*Primary Examiner*—Raymond A. Nelli

*Attorney, Agent, or Firm*—Antonelli, Terry & Wands

[57] ABSTRACT

A constant energy ignition system is disclosed. A first programmable one shot multivibrator controls the dwell of an energy storage device and the firing time to produce an ignition pulse from the stored energy. A second programmable one shot multivibrator, having a duty cycle inversely proportional to the power supply voltage provides the time base for the dwell. A control signal, proportional to the difference of the integrals of the outputs of the first and second one shot multivibrators controls the duty cycle of the first programmable one shot multivibrator.

7 Claims, 2 Drawing Sheets

CONSTANT SPARK ENERGY, INDUCTIVE DISCHARGE IGNITION SYSTEM

BACKGROUND OF THE INVENTION

1. Field of the Invention

The present invention relates to ignition systems. More particularly, the present invention relates to ignition systems which produce constant energy ignition pulses independent of power supply variation.

2. Description of the Prior Art

U.S. Pat. No. 4,019,484 discloses an ignition system for an internal combustion engine having a dwell time interval equal in duration to the low state of a first comparator. The duration of the low state has a duration equal to pulses outputted by a reference time generator. The reference time generator is a second comparator that produces an output pulse in response to the falling edge of each pulse produced by the first comparator which has a constant duration in a first embodiment and a duration which varies as a function of supply voltage in a second embodiment. The operation of this system is intended for use with a pick up coil which produces an AC signal. The operation of the comparators is based upon level comparison including a signal derived from the AC signal.

Other ignition systems are known which electronically control the dwell of the energy storage cycle to produce constant energy ignition pulses. See. U.S. Pat. Nos. 3,831,571, 3,937,193, 3,943,896, 4,018,202, 4,121,556, 4,212,280 and 4,237,835.

SUMMARY OF THE INVENTION

The present invention provides a low cost constant energy ignition system having a small number of conventional circuit components. Moreover, the ignition system provides compensation for supply voltage variation.

An ignition system in accordance with the invention which produces constant energy ignition pulses in response to a pulsating ignition timing signal includes an energy storage device, such as an ignition coil, for connection to a voltage source, for storing energy during the application of a dwell signal, which energy is released upon the application of a first astable output signal; a first one shot multivibrator responsive to an ignition timing signal for producing the first astable output signal, the first astable output signal having a variable time duration which is proportional to an applied first control signal; a second one shot multivibrator responsive to the ignition timing signal for producing a stable output signal and a second astable output signal; and a comparison circuit for comparing the magnitude of the first and second astable output signals to produce the first control signal.

The second one shot multivibrator may have a second control signal applied thereto which causes the second astable output signal to vary in time duration proportional to the magnitude of the applied second control signal, the magnitude of the second control signal being proportional to a change in the voltage source so that the time duration of the second astable pulses is inversely proportional to variation in magnitude of the voltage source.

The comparison circuit has a first integration circuit, connected to receive the first astable output pulses, for producing a first output signal which is an integral of the first astable output pulses; a second integration circuit, connected to receive the second astable output pulses, for producing a second output signal which is an integral of the second astable output pulses; and a differential amplifier, having two inputs respectively coupled to the first and second outputs for amplifying the difference between the first and second outputs to provide the first control signal.

The energy storage device has a switch having a pair of terminals between which current flows in response to the application of the dwell signal to a control terminal, and is interrupted upon application of the first astable signal to the control terminal, one of the pair of terminals being coupled to a reference potential; an inductor having a primary winding with a first terminal coupled to the voltage source and the other terminal coupled to another of a pair of terminals and a secondary which produces the ignition pulse each time the flow of current is interrupted in the primary; and current flowing from the voltage source through the primary to the reference potential upon the application of the dwell signal and being interrupted upon application of the first astable signal.

DESCRIPTION OF THE PREFERRED EMBODIMENTS

Figure 1:
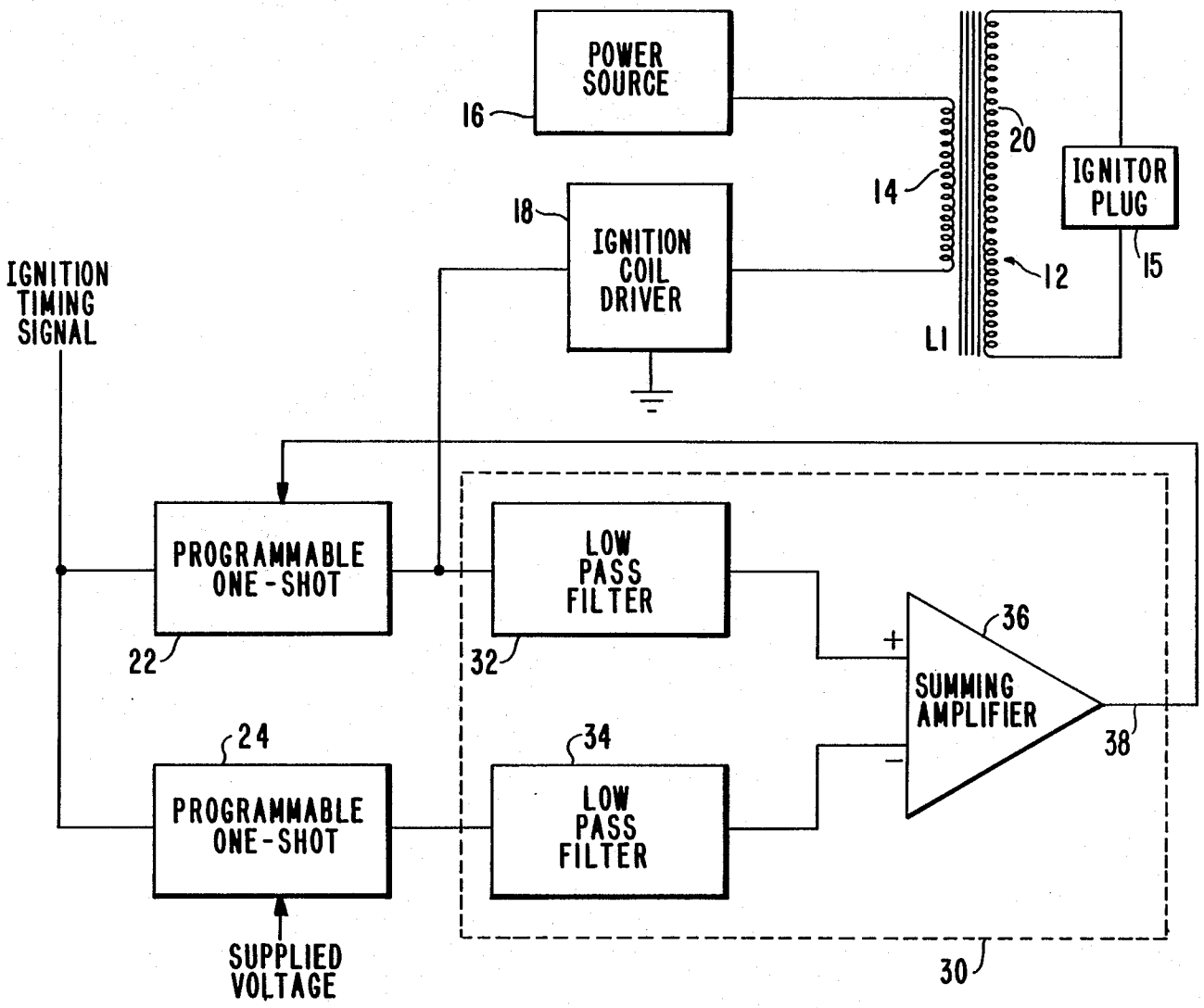
FIG. 1 is a block diagram of an embodiment of the present invention.

FIG. 1 illustrates a block diagram of an embodiment of the invention which produces constant energy ignition pulses independent of power supply variation. The generation of each ignition pulse is produced by the combination of an inductor 12 in the form of a standard ignition coil, having a primary winding 14 in which current flows from the power source 16 through a pair of terminals of an ignition coil driver 18 to ground during the presence of a dwell signal applied to the control terminal of the ignition coil driver 18, which may be a switch, such as a power transistor, and is interrupted by the application of a first astable signal to the control terminal. The interruption of current causes the magnetic field in the primary winding 14 to collapse which induces a counter e.m.f. to induce a high voltage pulse in the secondary 20, resulting in a spark discharge being generated across an igniter plug 15. This operation is conventional.

First and second controllable one shots 22 and 24 are each connected to receive an ignition timing signal (FIG. 2A) from a conventional ignition timing signal source and respectively produce first and second output signals each having astable and stable signal portions, the time duration of the astable signal portions being controllable in each case by respective control signals. The first output signal initiates the turning off of current flow in the ignition coil driver 18 during the astable signal portion thereof, and the stable signal portion thereof functions as the dwell signal whose duration controls the amount of energy stored in the ignition coil. More particularly, the one shot multivibrator 22 produces an output having an astable signal portion labeled "CONTROLLED" in FIG. 2B which is initiated in response to the rising edge of the ignition signal of FIG. 2A. The rising edge of the astable signal portion of the output of one shot multivibrator 22 turns off the ignition coil driver 18 to cause the ignition pulse to occur across the gap of the ignition plug. The stable signal portion of the output of one shot multivibrator 22 defines the DWELL signal which defines the time interval during which current flows in the primary 14. The astable signal portion of the second output signal produced by the programmable one shot multivibrator 24 in response to the rising edge of each ignition timing signal has a duration inversely proportional to an applied second control signal, which is proportional to the potential of the power supply. The astable signal portion of the second output signal is labelled "TIMED" in FIG. 2C. As the power supply voltage increases, it is necessary for the duration of the dwell signal to shorten for the reason that less time is required to build up the magnitude for energy stored in the primary winding 14 to the predetermined constant level desired to produce an ignition pulse of predetermined energy at the igniter plug 15. Conversely, as the power supply voltage decreases, it is necessary for the duration of the dwell signal to lengthen, since more time is required to build up the magnitude of energy stored in the primary winding 14 to produce an ignition pulse of the same predetermined energy. This variation in duration of the dwell signal is accomplished according to this invention by controlling the astable time of the one shot multivibrator 22 in accordance with the control output from the one shot multivibrator 24, causes the duration of the "DWELL" signal of FIG. 2B to proportionately vary to maintain constant energy for each ignition pulse independent of power supply variation. This unique control is effected by a control circuit 30 in response to the outputs of the one shot multivibrators 22 and 24.

The control circuit 30 produces the first control signal for controlling the one shot multivibrator 22 to vary the duration of the astable signal state thereof in proportion to variations in the duration of the stable signal state of the one shot multivibrator 24. For this purpose, the first and second output signals from the one shot multivibrators 22 and 24 are respectively integrated by low pass filters 32 and 34, which may be integrators, for converting the first and second output signals into proportional DC voltage magnitudes which are differentially amplified by differential amplifier 36 to produce the first control signal at the output 38 of the amplifier 36. As the magnitude of the first control signal decreases, the time period of the astable signal portion of one shot multivibrator 22 decreases, and visa versa.

Figure 2:
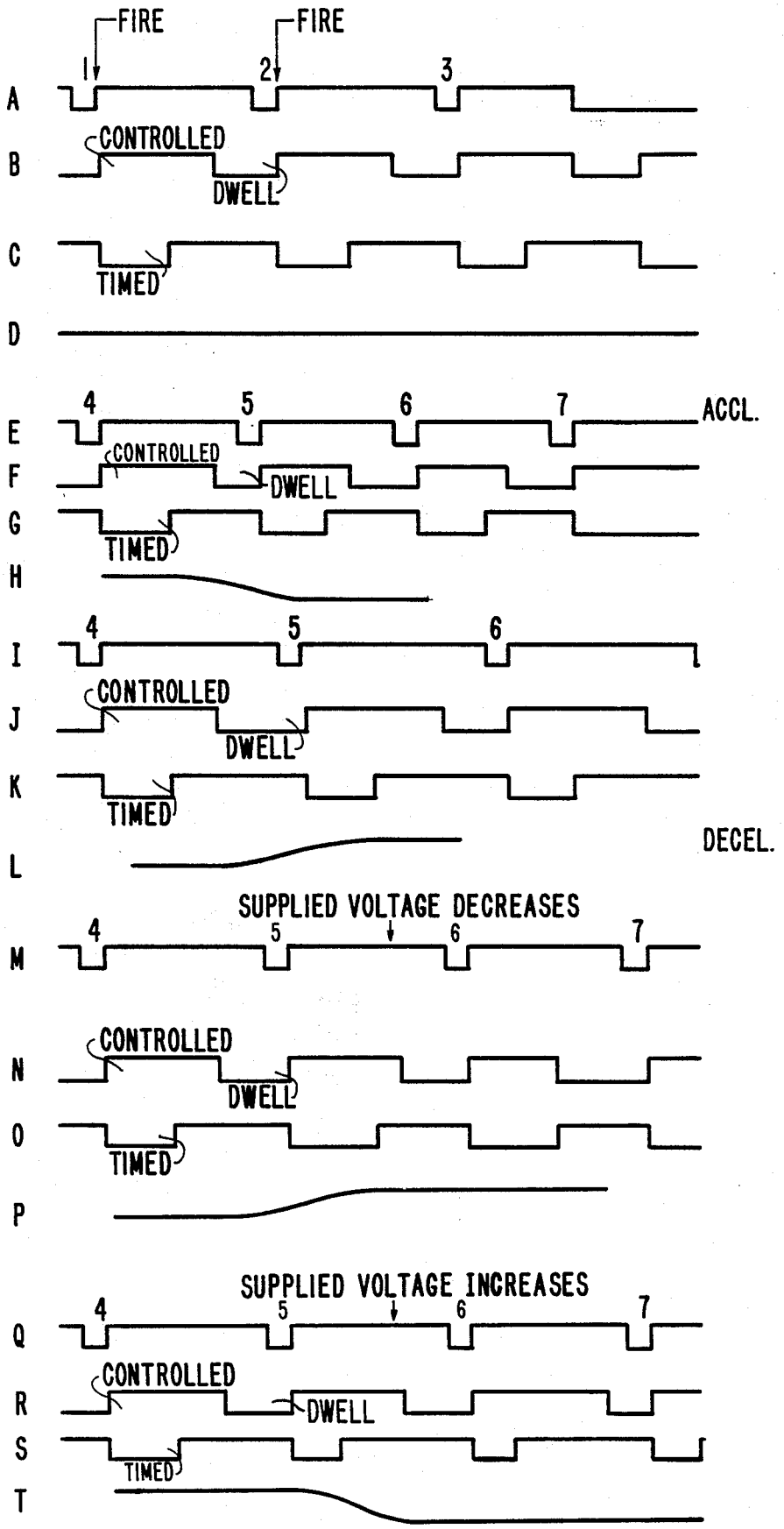
FIGS. 2A–T are a timing diagram of various signals which occur during the operation of the invention.

FIGS. 2A–2D illustrate the operation for constant engine speed and constant power supply potential. FIG. 2A illustrates the pulsating ignition timing signal. FIG. 2B illustrates the astable and stable signal portions of the output signal from the one shot multivibrator 22. The high level CONTROLLED signal is the astable signal portion and the low level DWELL signal is the stable signal portion of this first output signal. The ignition pulse is produced in response to the rising edge of the astable signal portion (dwell signal) as already described. It should be noted that the duration of the astable signal portion of the second output signal from the one shot multivibrator 24, labelled "TIMED" in FIG. 2C, is equal to the duration of the stable portion (DWELL signal) of the output of one shot multivibrator 22. In other words, the astable signal states of the one shot multivibrators 22 and 24 are of the same duration under these steady state conditions, and so the outputs of the two integrators 32 and 34 will produce an output from amplifier 36 which controls the one shot 22 to generate an output signal having a stable portion corresponding to the required dwell time. FIG. 2D illustrates the control voltage for the one shot multivibrator 22, which is constant for these steady state power and engine conditions.

FIGS. 2E–H illustrate the operation for a constant power supply potential and an acceleration from the operating speed of FIG. 2A. The identity of the waveforms of FIGS. 2E–H correspond respectively to the identity of the waveforms to FIGS. 2A–D as discussed above. However, the acceleration results in the pulses of the ignition timing signal coming more frequently, i.e. the interval between pulses is reduced, as seen in FIG. 2E. Thus, the dwell signal as seen in FIG. 2F, is cut short as compared to FIG. 2B. Similarly, the astable state of one shot multivibrator 24 is shortened, so that the duration of the astable states of the one shots are no longer equal. Thus, the control signal produced at the output 38 of amplifier 36 drops to decrease the duration of the astable signal portion of the output signal of one shot 22, thereby increasing the duration of the dwell signal. It should be noted that a single ignition pulse is required to bring the system back to constant dwell, as is apparent by the first stable DWELL signal of FIG. 2F below ignition timing signal "5" being two units long and three units long below ignition timing signal "6". The decrease in the magnitude of the first control signal causes the length of the CONTROLLED signal portion of the one shot multivibrator 22 to shorten which lengthens the DWELL signal back to the desired three units.

FIGS. 2I–L illustrate operation for constant power supply potential and a deceleration from the operating speed of FIG. 2A. The identity of the waveforms of FIGS. 2I–L correspond respectively to the identity of the waveforms of FIGS. 2A–D discussed above. The increase in the first control signal of multivibrator 22 of FIG. 2L causes a corresponding lengthening of the CONTROLLED signal portion of the one shot multivibrator 22 which shortens the DWELL signal from four units below ignition timing signal "5" to three units below ignition timing signal "6".

FIGS. 2M–P illustrate operation for constant speed and a 33% decrease in supply voltage between pulses "5" and "6". The identity of the waveforms of FIGS. 2M–P is identical to those described above with reference to FIGS. 2A–D. Between ignition timing signal "5" and "6" the supply voltage decreases 33%, which causes a corresponding signal increase in the first control signal for one shot multivibrator 22, as illustrated in FIG. 2P, to cause shortening of the CONTROLLED signal portion of FIG. 2N and the lengthening of the DWELL signal to four units. The addition of one additional unit of dwell is necessary to compensate for the 33% decrease in power supply potential to maintain a constant energy ignition pulse.

FIGS. 2Q–T illustrate the operation for a constant speed and a 33% decrease in supply potential between ignition timing signals "5" and "6". The identity of the waveforms of FIGS. 2Q–T is respectively identical to the waveforms discussed above with respect to FIGS. 2A–D. The CONTROLLED signal portion lengthens by one unit between ignition timing signals "5" and "6" in response to the drop in the first control signal for the one shot multivibrator 22 to cause the DWELL signal to decrease by 33% to compensate for the 33% increase in power supply potential to maintain a constant energy ignition pulse.

While the invention has been described in terms of its preferred embodiments, it should be noted that numerous modifications may be made without departing from the spirit and scope of the invention. It is intended that all such modifications fall within the scope of the appended claims.

I claim:

1. A constant energy ignition system which produces ignition pulses in response to a pulse ignition timing signal, comprising:

(a) energy storage means for storing energy from a voltage source during receipt of a dwell signal and for releasing said stored energy to produce an ignition pulse upon receipt of a first astable output signal;

(b) a first one shot multivibrator, responsive to said pulse ignition timing signal, for producing a first output signal in response to each pulse of said ignition timing signal applied thereto, said first output signal including a first astable signal and a first stable signal defining said dwell signal, the first astable signal having a variable time duration which is proportional to an applied first control signal;

(c) a second one shot multivibrator, responsive to said pulse ignition timing signal, for producing a second output signal in response to each pulse of said ignition timing signal applied thereto, said second output signal including a second astable signal and a second stable signal;

(d) means for detecting the difference between said first and second output signals to produce said first control signal and for applying said first control signal to said first one shot multivibrator to control the time duration of said first astable signal; and (e) means for applying said first astable signal and said dwell signal from said first one shot multivibrator to said energy storage means.

2. A constant energy ignition system in accordance with claim 1 wherein:

the second one shot multivibrator has a control signal applied thereto which controls time duration of the second stable signal as a function of the magnitude of the applied second control signal, the magnitude of the second control signal being proportional to the level of the voltage source so that the time duration of the second astable signal is inversely proportional to variation in magnitude of the voltage source.

3. A constant energy ignition system in accordance with claim 1 wherein said detecting means comprises:

(a) a first integration circuit, coupled to the output of said first one shot multivibrator, for producing a signal which is an integral of said first output signal;

(b) a second integration circuit, coupled to the output of said second one shot multivibrator, for producing a signal which is an integral of said second output signal; and (c) a differential amplifier, having two imputs respectively coupled to the first and second integration circuits, for amplifying the difference between the outputs thereof to produce the first control signal applied to the first one shot multivibrator.

4. A constant energy ignition system in accordance with claim 2 wherein said detecting means comprises:

(a) a first integration circuit, coupled to the output of said first one shot multivibrator, for producing a signal which is an integral of said first output signal;

(b) a second integration circuit, coupled to the output of said second one shot multivibrator, for producing a signal which is an integral of said second output signal; and (c) a differential amplifier, having two inputs respectively coupled to the first and second integration circuits, for amplifying the difference between the outputs thereof to produce the first control signal applied to the first one shot multivibrator.

5. A circuit in an ignition system for providing constant spark energy during each firing period, comprising:

an ignition coil driver, coupled to a primary inductive winding of an ignition transformer and to a voltage supply, and being responsive to a first astable signal and a stable dwell signal, for controlling the generation of a spark discharge whose energy is determined by the magnitude of said voltage supply and the duration of said stable dwell signal and whose timing is determined by the timing of said first astable signal;

first means, responsive to an ignition timing signal, for producing the first astable signal and the stable dwell signal with a time duration which is controllable in response to an applied control signal;

second means, responsive to the ignition timing signal and the magnitude of the voltage supply, for producing a second astable pulse signal having a pulse width inversely proportional to the magnitude of a voltage supplied by the voltage source; and means, connected to receive outputs of said first and second means, for generating a variable control signal which is a function of variations in the pulse width of said first and second astable signals, and for transmitting the control signal to a control input of said first means so as to regulate the time duration of the dwell signal.

6. A circuit in an ignition system according to claim 5, wherein:

each of said first and second means comprises a controllable one-shot multivibrator.

7. A circuit in an ignition system according to claim 6 wherein:

the means for generating the variable control signal comprises integration means for integrating the outputs of said first and second means and a differential amplifier connected to receive the integrated outputs from said integration means for producing said control signal.

* * * * *